US007542020B2

(12) United States Patent
Jeong et al.

(10) Patent No.: US 7,542,020 B2
(45) Date of Patent: Jun. 2, 2009

(54) POWER SUPPLY DEVICE AND PLASMA DISPLAY DEVICE INCLUDING POWER SUPPLY DEVICE

(75) Inventors: Seong-Joon Jeong, Suwon-si (KR); Jin-Ho Yang, Suwon-si (KR); Woo-Joon Chung, Suwon-si (KR); Tae-Seong Kim, Suwon-si (KR); Suk-Jae Park, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 326 days.

(21) Appl. No.: 11/352,268

(22) Filed: Feb. 13, 2006

(65) Prior Publication Data

US 2006/0267865 A1 Nov. 30, 2006

(30) Foreign Application Priority Data

May 25, 2005 (KR) ..... 10-2005-0044019

(51) Int. Cl.
*G09G 3/36* (2006.01)

(52) U.S. Cl. ..... 345/92; 345/214; 345/212; 345/204; 345/99

(58) Field of Classification Search ..... 345/66, 345/63, 62, 60, 77, 76, 102, 211–214, 92, 345/94, 99, 204; 315/247, 246, 209 R, 224, 315/225

See application file for complete search history.

(56) References Cited

U.S. PATENT DOCUMENTS 5,281,866 A 1/1994 Rundel
5,404,051 A 4/1995 Kobayashi
5,557,221 A 9/1996 Taguchi et al.
6,046,623 A * 4/2000 Hasegawa ..... 327/509
6,201,437 B1 3/2001 Kono et al.
6,590,345 B2 7/2003 Myoung et al.
6,628,087 B2 9/2003 Roh et al.
6,961,031 B2 * 11/2005 Lee et al. ..... 345/60
7,307,601 B2 * 12/2007 Lee et al. ..... 345/60
7,319,442 B2 * 1/2008 Nakamura et al. ..... 345/60
7,379,058 B2 5/2008 Toyozawa et al.

(Continued)

FOREIGN PATENT DOCUMENTS

CN 1504983 6/2004

(Continued)

*Primary Examiner*—Tuyet Vo
(74) *Attorney, Agent, or Firm*—Lee & Morse, P.C.

(57) ABSTRACT

A power supply that is employable by a plasma display device for generating and supplying a plurality of voltages, the power supply including a first power source generating and supplying a first voltage, a transistor having a drain electrically coupled to the first power source, a first resistor having a first end coupled to the first power source and a second end electrically coupled to a gate of the transistor, a second resistor having a first end coupled to the second end of the first resistor and a second end electrically coupled to a second power source supplying a second voltage that is lower than the first voltage, and a capacitor having a first end coupled to a source of the transistor and a second end electrically coupled to the second power source. The coupling of the first end of the capacitor to the source of the transistor may form a third voltage supply node having the third voltage when the capacitor is charged.

20 Claims, 3 Drawing Sheets

U.S. PATENT DOCUMENTS

| | | | |
|---|---|---|---|
| 7,468,713 | B2 | 12/2008 | Ogawa et al. |
| 2003/0098822 | A1 | 5/2003 | Park et al. |
| 2004/0104869 | A1 | 6/2004 | Jeong |
| 2005/0040770 | A1 | 2/2005 | Kang et al. |

FOREIGN PATENT DOCUMENTS

| | | | |
|---|---|---|---|
| CN | 1612191 | | 5/2005 |
| EP | 1 024 474 | | 8/2000 |
| EP | 1 237 142 | | 9/2002 |
| JP | 52-031647 | | 3/1977 |
| JP | 57-030193 | A | 2/1982 |
| JP | 61-234120 | A | 10/1986 |
| JP | 63-150713 | | 6/1988 |
| JP | 04-123466 | | 4/1992 |
| JP | 05-216546 | A | 8/1993 |
| JP | 05-259862 | A | 10/1993 |
| JP | 06-326591 | | 11/1994 |
| JP | 11-288588 | | 10/1999 |
| JP | 2000-299194 | A | 10/2000 |
| JP | 2002-156943 | | 5/2002 |
| JP | 2002-207449 | | 7/2002 |
| JP | 2002-221703 | A | 8/2002 |
| JP | 2003-015600 | A | 1/2003 |
| JP | 2004-206094 | A | 7/2004 |
| JP | 2004-226787 | | 8/2004 |

* cited by examiner

POWER SUPPLY DEVICE AND PLASMA DISPLAY DEVICE INCLUDING POWER SUPPLY DEVICE

BACKGROUND OF THE INVENTION

1. Field of the Invention

The present invention relates to a plasma display device. More particularly, the invention relates to a power supply for supplying a voltage for driving the plasma display device.

2. Description of the Related Art

A plasma display device is a display device that uses plasma generated by gas discharge to display characters and/or images. A plasma display device may include millions of pixels arranged in a matrix pattern. The number of pixels in a plasma display device generally depends on the size of the plasma display device. Plasma display devices may be classified as a direct current (DC) type or an alternating current (AC) type based on the discharge cell structure and the waveform of the driving voltage applied to the plasma display device.

A DC-type plasma display device may have electrodes exposed to a discharge space. The electrodes enable direct current to flow through the discharge space when a voltage is applied. Therefore, such DC-type plasma display devices generally require a resistance for limiting the current.

An AC-type plasma display device may have electrodes covered with a dielectric layer that forms a capacitance component that helps limit the current and helps protect the electrodes from damage that may occur from the impact of ions colliding with boundaries of the discharge cells during discharge. Generally, AC-type plasma display devices may have longer lifetimes than DC-type plasma display devices.

Plasma display devices may sequentially display a plurality of frames displaying respective images that appear to be continuous to the human eye. For example, a plasma display device may display 30 to 60 frames per second. Each frame generally includes a plurality of sub-fields, e.g., 8 to 12 subfields per frame.

Each subfield may include a reset period, an addressing period, and a sustain period. During the reset period, the status of each discharge cell may be initialized. Initialization may facilitate an addressing operation that may be performed later on the discharge cell. During the addressing period, respective ones of the discharge cells of the plasma display device may be selectively turned on, i.e., addressed or turned-off. During the sustain period, a discharge may be initiated in the discharge cells turned on, i.e., addressed, during the previous addressing period to display an image.

To perform various operations, such as initializing, addressing and sustaining operations, the plasma display device may include a power supply for supplying power to the circuit(s)/component(s) of the plasma display panel. The power supply may supply the one or more voltages necessary for performing the various operations. For example, the power supply may supply one or more voltages, e.g., Vs, Vset, Ve, Va, Vnf, VscH and VscL, that may be required for performing a plasma discharge operation to a driving circuit of the plasma display device. The power supply may supply other circuits, such as an image processor, a fan, an audio amplifier, and a control circuit with a voltage for operating the respective circuits.

Generally, the cost of the power supply depends on the number and/or magnitude of the voltages, e.g., Vs, Ve, Va, etc., that the power supply is to supply. Know power supplies employ a separate power source for each of the various voltages. As each power source is associated with a cost, in general, the greater then number of power sources a power supply requires in order to supply the different voltages, the greater the cost of the power supply. Thus, in general, the greater the number of different voltages that the power supply is to generate, the greater the number of power sources and the cost of the power supply.

The information disclosed above in this Background section is only provided only to aid in the understanding of one or more aspects of the invention and is not to be considered nor construed as constituting prior art.

SUMMARY OF THE INVENTION

The present invention is therefore directed to a power supply and a plasma display panel employing such a power supply, which substantially overcome one or more of the problems due to the limitations and disadvantages of the related art.

It is therefore a feature an of embodiment of the present invention to provide an improved power supply for a plasma display device that employs a reduced number of power sources in relation to known power supplies.

Another feature of an embodiment of the present invention to provide a power supply that may be manufactured at a lower material cost than known power supplies capable of supplying the same number of voltages.

Yet another feature of an embodiment of the present invention to provide a plasma display device employing a power supply with a reduced number of power sources.

Still another feature of an embodiment of the present invention to provide a plasma display device that employs a power supply that may be manufactured at a lower material cost than known power supplies capable of supplying the same number of voltages.

At least one of the above and other features and advantages of the present invention may be realized by providing a power supply that is employable by a plasma display device for generating and supplying a plurality of voltages, and which may include a first power source that generates and supplies a first voltage, a transistor having a drain electrically coupled to the first power source, a first resistor having a first end coupled to the first power source and a second end electrically coupled to a gate of the transistor, a second resistor having a first end coupled to the second end of the first resistor and a second end electrically coupled to a second power source supplying a second voltage that is lower than the first voltage, and a capacitor having a first end coupled to a source of the transistor and a second end electrically coupled to the second power source. The coupling of the first end of the capacitor to the source of the transistor may form a third voltage supply node having the third voltage when the capacitor is charged.

At least one of the first resistor and the second resistor may be a variable resistor. The second voltage may be a ground voltage. A third resistor may be coupled between the first power source and the drain of the transistor.

At least one of the above and other features and advantages of the present invention may be separately realized by providing a plasma display device having a plasma display panel including a plurality of first electrodes, a plurality of second electrodes, a plurality of third electrodes crossing the first and second electrodes, a plurality of discharge cells formed between adjacent ones of the first, second and third electrodes, a driver and a power supply. The driver may gradually decrease a voltage of the second electrodes to a first voltage during a reset period, may selectively address discharge cells from the plurality of discharge cells during an addressing period, may apply a second voltage to the first electrodes and the second electrodes during at least a portion of a sustain period, and may bias the first electrodes with a third voltage during a falling period of the reset period and the addressing period.

The power supply may supply a plurality of voltages to the driver. The power supply may include a first power source supplying the second voltage to the first and second electrodes, a transistor having a drain electrically coupled to the first power source, a first resistor having a first end coupled to the first power source and a second source electrically coupled to a gate of the transistor, a second resistor having a first end coupled to the second end of the first resistor and a second end electrically coupled to a second power source supplying a fourth voltage that is lower than the second voltage and a capacitor. The capacitor may have a first end coupled to a source of the transistor and a second end electrically coupled to the second power source, the first end of the capacitor may have a voltage based on a charge stored in the capacitor, the coupling of the first end of the capacitor to the source of the transistor may form a third voltage supply node that may supply the third voltage to the first electrodes.

At least one of the first resistor and the second resistor may be a variable resistor. A third resistor may be coupled between the first power source and the drain of the transistor. The capacitor may be charged with the third voltage when the transistor is turned on. The fourth voltage may be a ground voltage. The first voltage may be lower than the fourth voltage. The third voltage may be higher than the fourth voltage.

At least one of the above and other features and advantages of the present invention may be separately realized by providing a power supply employable by a plasma display device, the power supply including a first power source supplying a first voltage, a capacitor having a first end and a second end, the second end of the capacitor being connected to a second power source supplying a second voltage, and power distributing mechanism for selectively distributing a portion of the power from the first power source to the capacitor. The first end of the capacitor may be connected to the power distributing mechanism and may form a third voltage supply node of the power supply. When the capacitor is charged, the third voltage supply node may have a voltage equal to the third voltage, wherein the first voltage, the second voltage and the third voltage are different voltages.

The power distributing mechanism may include at least one variable resistor. The third voltage may be less than the first voltage. The power distributing member may include a switching device for selectively charging the capacitor.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
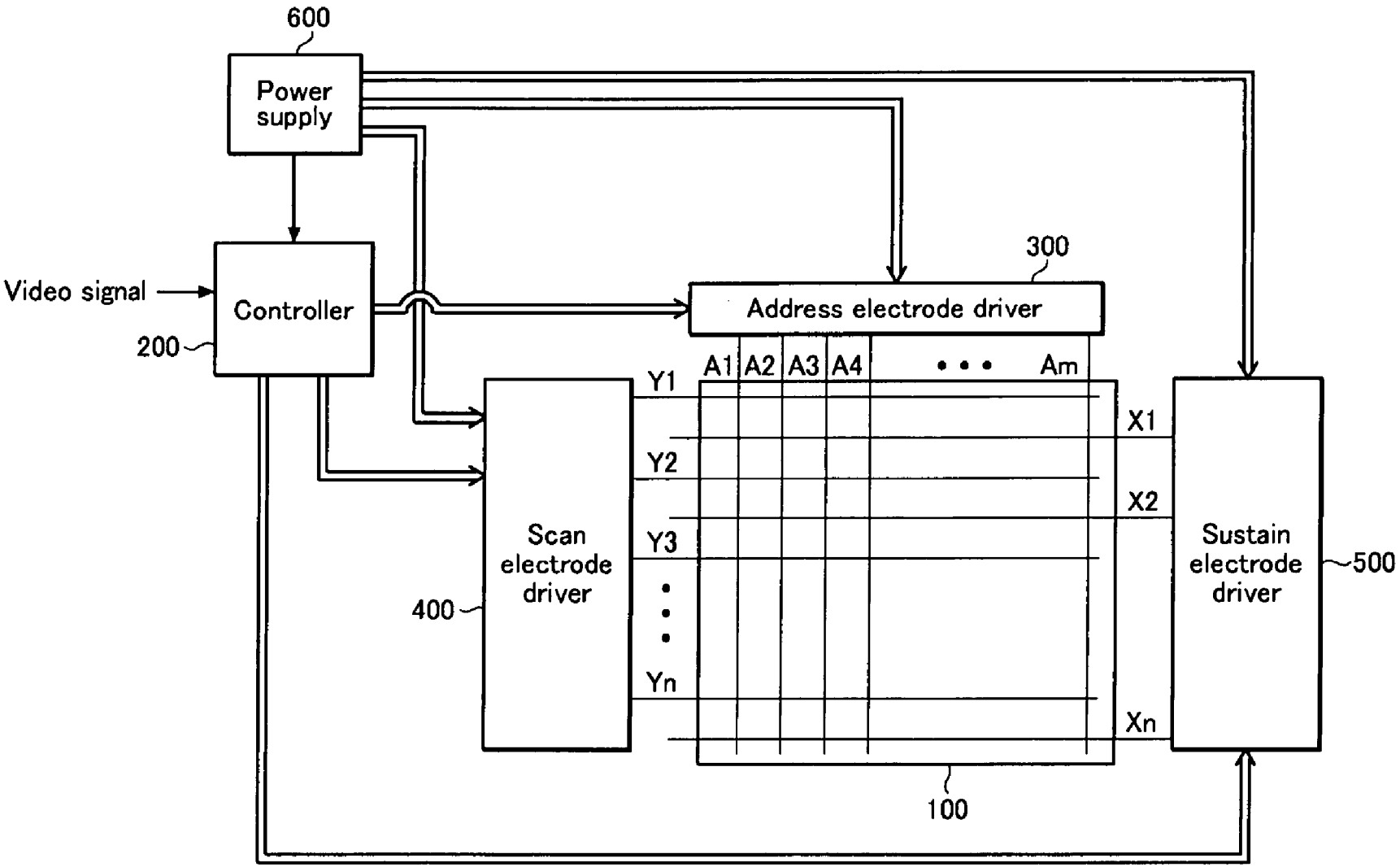
FIG. 1 shows a plasma display device according to an exemplary embodiment of the invention.

Korean Patent Application No. 10-2005-0044019 filed on May 25, 2005, in the Korean Intellectual Property Office, and entitled, "Plasma Display Device and Power Device Thereof," is incorporated by reference herein in its entirety.

The invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Also, in the following description reference to an "electrode" may correspond to a portion of an electrode associated with a single discharge cell and/or an electrode extending across a plurality of discharge cells. Like reference numerals refer to like elements throughout.

A schematic structure of a plasma display device according to an exemplary embodiment of the invention will now be described in detail with reference to FIG. 1. FIG. 1 illustrates a plasma display device according to an exemplary embodiment of the invention.

As shown in FIG. 1, the plasma display device may include a plasma display panel 100, a controller 200, an address electrode driver 300, a scan electrode driver 400, a sustain electrode driver 500, and a power supply 600.

The plasma display panel 100 may include a plurality of electrodes. In particular, the plasma display panel 100 may include a plurality of address electrodes A1-Am extending along a first direction and a plurality of sustain electrodes X1-Xn and a plurality of scan electrodes Y1-Yn extending along a second direction. Ends of the sustain electrodes X1-Xn may be commonly connected. The plasma display panel 100 may include a first substrate (not shown) having some of the electrodes, e.g., the sustain and scan electrodes X1-Xn and Y1-Yn formed, thereon and a second substrate (not shown) having other ones of the electrodes, e.g., address electrodes A1-Am, formed thereon. The first substrate and the second substrate may be arranged to face each other with a discharge space between them. The address electrodes A1-Am may cross or overlap, e.g., extend perpendicular to, the scan electrodes Y1-Yn and sustain electrodes X1-Xn. The discharge space may include a plurality of discharge cells substantially corresponding to areas between overlapping portions of the address electrodes A1-Am, the sustain electrodes X1-Xn and the scan electrodes X1-Xn and Y1-Yn. Each discharge cell may substantially correspond to the space between a portion of the respective one of the address electrodes A1-Am and an overlapping portion of each of the corresponding ones of the sustain electrodes X1-Xn and the scan electrodes Y1-Yn.

The controller 200 may externally receive video signals and may output an address driving control signal, a sustain driving control signal, and a scan driving control signal. The power supply 600 may supply the power necessary for driving the plasma display device to the controller 200, the address electrode driver 300, the scan electrode driver 400, and the sustain electrode driver 500, respectively. As discussed below, the power supply 600 may generate a number C of voltages using a number B of power sources, where both B and C are numbers and C is greater than B (C>B). The controller 200 may control the operations to be performed during each subfield of a frame. Each subfield may include a reset period, an addressing period, and a sustain period.

During the addressing period of each subfield, the address electrode driver 300 may receive the respective address driving control signal from the controller 200 and may apply display data signals to the respective address electrodes A1-Am. The display data signals may selectively turn on one or more of the discharge cells that will engage in a discharge operation during the sustain period of that subfield.

During the sustain period of each subfield, the scan electrode driver 400 may receive the scan driving control signal from the controller 200 and may apply a driving voltage to the scan electrodes Y1-Yn and/or the sustain electrode driver 500 may receive the sustain driving control signal from the controller 200 and may apply a driving voltage to the sustain electrodes X1-Xn. The respective driving voltages may be alternately applied to all the scan electrodes Y1-Yn and all the sustain electrodes X1-Xn.

Driving waveforms that may be respectively applied by the address electrode driver 300, the sustain electrode driver 500 and the scan electrode driver 400 to the address electrodes A1-Am, the sustain electrodes X1-Xn, and the scan electrodes Y1-Yn during each subfield will be described below with reference to FIG. 2.

Figure 2:
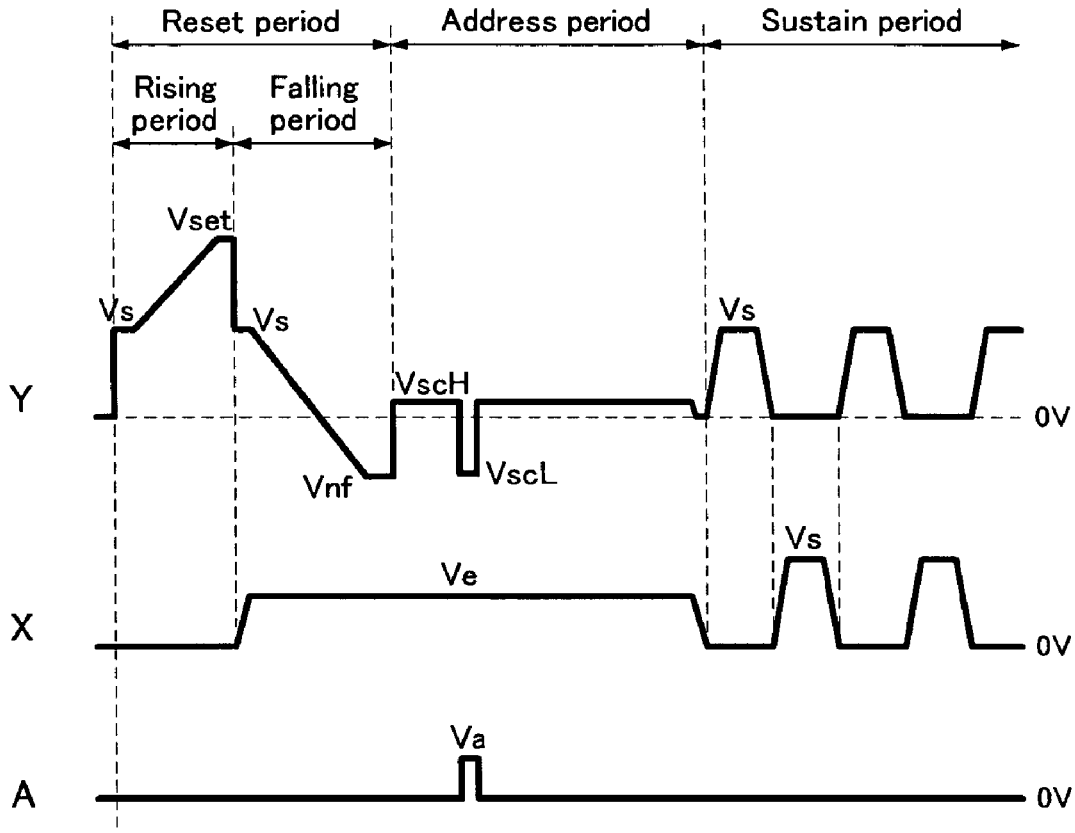
FIG. 2 is a diagram of a driving waveform employable by a plasma display device according to an exemplary embodiment of the invention.

FIG. 2 is a diagram of an exemplary embodiment of a driving waveform employable by a plasma display device. In particular, FIG. 2 illustrates one exemplary subfield and exemplary driving waveforms that may be applied to a sustain electrode Y, a scan electrode X and an address electrode A associated with a discharge cell. One or more aspects of the invention described in relation to the exemplary subfield illustrated in FIG. 2 may be employed during one, some or all of the subfields of a frame.

As shown in FIG. 2, each subfield may include a reset period, an address period, and a sustain period. The reset period may include a rising period and a falling period. The falling period may follow the rising period.

During the rising period of the reset period, a rising waveform may be applied to the scan electrode Y. The rising waveform may increase a voltage of the scan electrode Y from a first voltage Vs to a second voltage Vset during a period when the sustain electrode X is maintained at 0V. A first weak reset discharge may then occur between the scan electrode Y and the address electrode A and between the scan electrode Y and the sustain electrode X. As a result of the first weak reset discharge, negative (−) wall charges may form on the scan electrode Y and positive (+) wall charges may form on the address electrode A and the sustain electrode X.

During the falling period of the reset period, a falling waveform may be applied to the scan electrode Y. The falling waveform may decrease the voltage of the scan electrode Y from the first voltage Vs to a third voltage Vnf during a period when the sustain electrode X is maintained at a fourth voltage Ve. A second weak reset discharge may occur between the scan electrode Y and the sustain electrode X and between the scan electrode Y and the address electrode A when the voltage of the scan electrode Y is decreased. The negative wall charges (−) that may exist on the scan electrode Y and the positive (+) wall charges that may exist on the sustain electrode X and the address electrode A as a result of the first weak reset discharge may be reduced and/or eliminated as a result of the second weak reset discharge. In embodiments of the invention, some wall charges may remain in each of the discharge cells to help initiate discharge during the addressing period.

Subsequently, during the address period for selectively turning on, i.e., addressing, discharge cells, a scan pulse VscL and an address pulse Va may be respectively applied to the scan electrode Y and the address electrode A associated with the discharge cell(s) to be turned on, i.e., addressed. The non-selected scan electrode(s) Y of the plasma display device may be biased at a fifth voltage VscH that may be higher than the voltage of the scan pulse VscL. A reference voltage may be applied to the address electrode A of the discharge cells to be turned or maintained off.

In the discharge cells that are to undergo a discharge during the subsequent sustain period, the respective address discharge may be generated as a result of a voltage difference between the address voltage Va applied to the address electrode A and the scan pulse VscL applied to the scan electrode Y, and a wall voltage that may exist due to wall charges that may be present on the address electrode A and scan electrode Y. For example, positive (+) wall charges may be present on the scan electrode Y, negative (−) wall charges may be present on the sustain electrode X and/or negative (−) wall charges may be present on the address electrode A of the discharge cell being addressed.

As shown in the exemplary addressing period shown in FIG. 2, to initiate a discharge, e.g., an address discharge, in the respective discharge cell to be addressed, the scan pulse VscL may be applied to the scan electrode Y during the same time the address pulse Va is applied to the address electrode.

Subsequently, during the sustain period, a sustain discharge pulse Vs may be sequentially applied to the scan electrode Y and the sustain electrode X. A discharge may be generated between the scan electrode Y and the sustain electrode X as a result of the first voltage Vs and the wall voltage generated between the scan electrode Y and the sustain electrode X by the address discharge during addressing of the respective discharge cell during the address period. Subsequently, sustain pulses with the first voltage Vs may be alternately and/or repeatedly applied to the scan electrode Y and the sustain electrode X based on a weight value of a corresponding subfield. When the sustain period of the subfield ends, another subfield may begin and the process may continue until the frame ends.

An exemplary embodiment of a method for supplying and/or generating a plurality of voltages, e.g., Ve, Vs, using the power supply 600 including a power source 605 with a voltage potential equal to the first voltage Vs and a circuit that may include electronic components, e.g., R1, R2, R3, M1, C1, will be described in more detail with reference to FIG. 3. In the first exemplary embodiment of the invention, a separate power source for generating each of the first voltage Vs and the fourth voltage Ve is not provided. In particular, as shown in the exemplary embodiment illustrated in FIG. 3 only the power source 605 supplying the first voltage Vs may be provided and the power source 605 may be employed to generate and supply the fourth voltage Ve.

Figure 3:
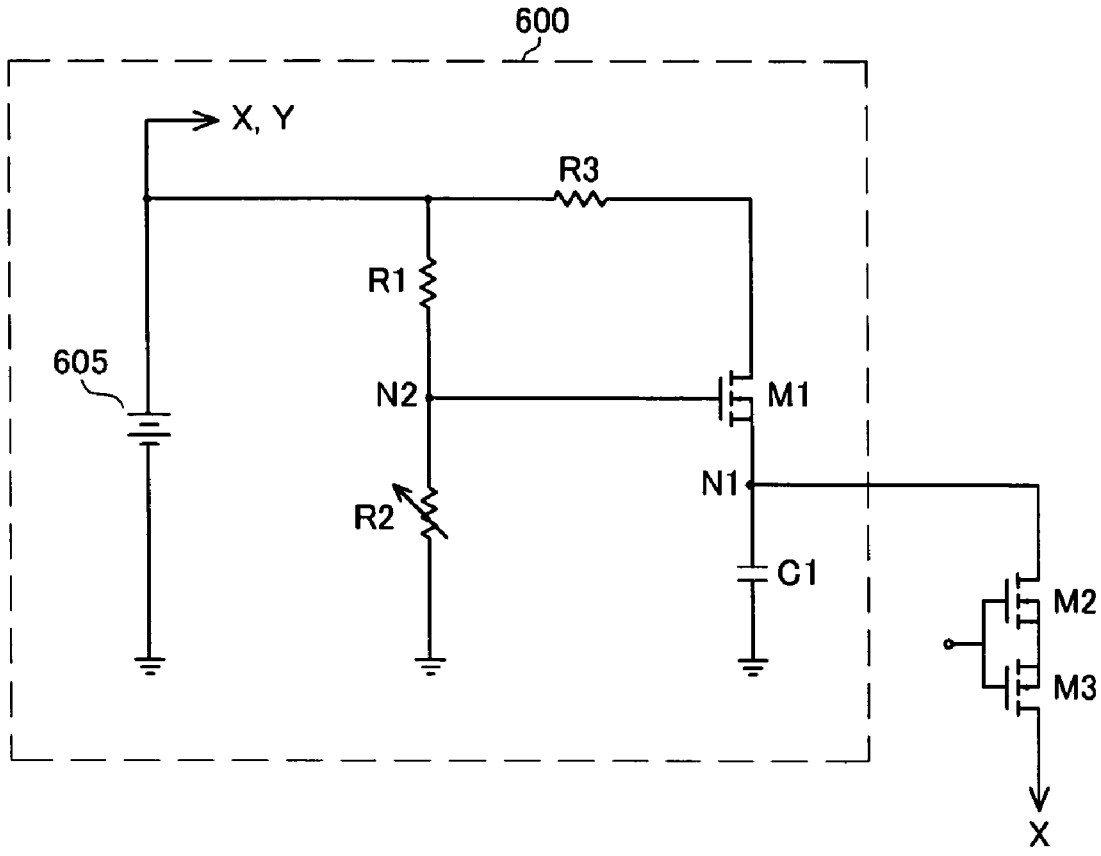
FIG. 3 shows a partial circuit of an exemplary embodiment of a power supply employable by a plasma display device according to an exemplary embodiment of the invention.

FIG. 3 shows a portion of an output terminal of the exemplary embodiment of the power supply 600 employable by the exemplary plasma display device illustrated in FIG. 1. As shown in FIG. 3, the sustain electrode X may be supplied with the fourth voltage Ve from a first node N1 of the power supply 600 that may include power source 605 supplying the first voltage, e.g., a sustain discharge voltage, Vs. Although the power supply 600 may include the first node N1 that may correspond to the fourth voltage Ve, the power supply 600 does not include a separate power source for supplying the fourth voltage Ve. One or more aspects of the invention may be employed to reduce a number of power sources employed by a power supply to supply voltages other than and/or in addition to the first voltage Vs and/or the fourth voltage Ve.

As shown in FIG. 3, the power supply 600 of the plasma display device may include the power source 605 that may supply the first voltage Vs, fixed resistors R1 and R3, a variable resistor R2, a capacitor C1, and transistors M1, M2, and M3.

As shown in FIG. 3, a negative (−) terminal of the power source 605 may be coupled to a ground power source and a positive (+) terminal of the power supply 605 may be coupled to a first end of the fixed resistor R1. A first end of the variable resistor R2 may be coupled to a second end of the fixed resistor R1, and a second end of the variable resistor R2 may be coupled to the ground power source. A first end of the fixed resistor R3 may be coupled to the positive (+) terminal of the power supply 605 and a second end of the fixed resistor R3 may be coupled to a drain of the transistor M1.

A gate of the transistor M1 may be coupled to a second node N2 of the power supply 600. The second node N2 may correspond to the second end of the fixed resistor R1. At the first node N1, a source of the transistor M1 may be coupled to a drain of the transistor M2. A first end of the capacitor C1 may be coupled to the first node N1 and thus, also to the source of the transistor M1. A second end of the capacitor C1 may be coupled to the ground power source.

The transistors M2 and M3 shown in FIG. 3 may function as switches for supplying the fourth voltage Ve to the plasma display device. A source of the transistor M2 and a source of the transistor M3 may be coupled to each other, and a gate of the transistor M2 and a gate of the transistor M3 may also be coupled to each other such that a back-to-back switch may be formed. In FIG. 3, the transistors M2 and M3 forming the back-to-back switch may be provided to prevent a current from flowing to the power supply 600 through a body diode if the first voltage Vs supplied to the plasma display panel 100 is higher than the fourth voltage Ve in FIG. 3. In embodiments of the invention, such a switch may be formed by a single transistor if, for example, the first voltage Vs is not higher than the fourth voltage Ve. As shown in FIG. 3, a drain of the transistor M3 may be coupled to the sustain electrodes X1-Xn of the plasma display panel 100.

The power source 605 may supply the first voltage Vs that may be applied to the scan electrode Y during the reset period and may be alternately applied to the sustain electrode X and the scan electrode Y during the sustain period.

A method for generating the fourth voltage Ve employing the power supply 600 without employing a separate power source supplying the fourth voltage will be described with reference to FIG. 3.

As shown in FIG. 3, the power source 605 may be coupled to the fixed resistor R1, which may be coupled to the variable resistor R2. The gate of the transistor M1 may be connected to the second node N2 of the power supply 600. The second node N2 may correspond to the second end of the fixed resistor R1 and the first end of the variable resistor R2. A relationship between the first voltage Vs supplied by the power source 605 and a gate voltage Vg of the transistor M1, which may correspond to the voltage at the second node N2, may be characterized by Equation 1 based on principles of voltage distribution.

$$Vg = \frac{R2}{R1 + R2} Vs \qquad \text{[Equation 1]}$$

As shown in Equation 1, the gate voltage Vg of the transistor M1 may be determined depending on resistances of the fixed resistor R1 and the variable resistor R2. In particular, the gate voltage Vg of the transistor M1 may be controlled by the variable resistor R2 by varying the resistance of the variable resistor R2. As discussed above, the resistor R3 may be coupled between the power source 605 and the drain of the transistor M1 to prevent an inrush current.

According to an exemplary embodiment of the invention, the fourth voltage Ve that may correspond to a charge at the first end of the capacitor C1 may be applied to the sustain electrode X during the falling period of the reset period and during the addressing period without employing a separate power source supplying the fourth voltage Ve. In the exemplary embodiment, a level of the voltage stored in the capacitor C1 may equal a voltage level at the source of the transistor M1 and may correspond to the voltage level at the first node N1 because the second end of the capacitor C1 may be coupled to the ground power source.

If the capacitor C1 is not charged, the level of the voltage at the terminal Ve corresponding to the first voltage of the capacitor C1, the source of the transistor M1 and the drain of the transistor M2 is 0V. When the first voltage Vs is supplied, the predetermined voltage Vg may be applied to the gate of the transistor M1. At this time, if a gate-source voltage of the transistor M1 is greater than a threshold voltage Vth, and accordingly, the transistor M1 will be turned on. According to Equation 1, the gate voltage of the transistor M1 may correspond to the predetermined voltage Vg based on the resistances of the fixed resistor R1 and the variable resistor R2.

If the transistor M1 is turned on, a current may flow to a source of the transistor M1 and that current may charge the capacitor C1. In the exemplary embodiment, the level of the voltage at the second node N2 increases based on a charge level of the capacitor C1.

When the level of the voltage at the first node N1 that may correspond to the source voltage of the transistor M1 reaches a predetermined voltage level, the transistor M1 may be turned off immediately as the gate-source voltage of the transistor M1 may become lower than the threshold voltage Vth as the gate voltage Vg may be controlled by the variable resistor R2.

The voltage at the first node N1 that may correspond to the fourth voltage Ve and may be generated until the transistor M1 is turned off may be applied to the sustain electrode X during the falling period of the reset period and/or during the addressing period for driving the plasma display device.

In embodiments of the invention, the first voltage Vs may be between about 175V to about 210V. In embodiments of the invention, the fourth voltage Ve may be about 100V.

Assuming that the fourth voltage Ve for driving the plasma display device is about 100V, the fixed resistor R1 and the variable resistor R2 may be controlled to set the level of the voltage Vg at the second node N2 to be about (100+Vth)V when the first voltage Vs is applied.

When the transistor M1 is turned on, the transistor M1 may be maintained in the on state until the voltage level at the first node N1 reaches approximately 100V. In the exemplary embodiment of the invention, a separate power source for supplying the fourth voltage Ve is not necessary for driving the plasma display device because the fourth voltage Ve may be generated at the first node N1 in accordance with the charge at the first end of the capacitor C1 and the resulting fourth voltage Ve may be applied to the sustain electrode(s) X for driving the plasma display device.

In embodiments of the invention, locations of the resistor R1 and the resistor R2 may be changed.

In embodiments of the invention, the number of power sources of the plasma display device may be reduced in relation to known plasma display devices. One or more aspects of the invention provide power supplies employable by plasma display devices that are capable of supplying a greater number of different voltages than a number of power sources employed by the power supply. One or more aspects of the invention enable costs associated with power sources for supplying various voltages to be reduced. Embodiments of the invention provide circuitry for reducing and/or preventing damage to components of the power supply of employed by the plasma display devices.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A power supply employable by a plasma display device having first and second electrodes, the power supply configured to generate and supply a plurality of voltages, the power supply comprising:

a first power source configured to generate and supply first voltage;

a transistor having a drain electrically coupled to the first power source;

a first resistor having a first end coupled to the first power source and a second end electrically coupled to a gate of the transistor;

a second resistor having a first end coupled to the second end of the first resistor and a second end electrically coupled to a second power source configured to supply a second voltage that is lower than the first voltage; and a capacitor having a first end coupled to a source of the transistor and a second end electrically coupled to the second power source, the coupling of the first end of the capacitor to the source of the transistor forming a third voltage supply node having the third voltage when the capacitor is charged, wherein the power supply is configured to alternately supply the first and second electrodes with the first and second voltages during a sustain period, and to bias the second electrodes with the third voltage during an address period.

2. The power supply as claimed in claim 1, wherein the capacitor is charged with the third voltage when the transistor is turned on.

3. The power supply as claimed in claim 1, wherein the second voltage is a ground voltage.

4. The power supply as claimed in claim 1, wherein at least one of the first resistor and the second resistor is a variable resistor.

5. The power supply as claimed in claim 4, wherein the second voltage is a ground voltage.

6. The power supply as claimed in claim 4, further comprising a third resistor coupled between the first power source and the drain of the transistor.

7. The power supply as claimed in claim 6, wherein the second voltage is a ground voltage.

8. A power supply employable by a plasma display device configured to generate and supply a plurality of voltages, the power supply comprising:

a first power source configured to generate and supply a first voltage;

a transistor having a drain electrically coupled to the first power source;

a first resistor having a first end coupled to the first power source and a second end electrically coupled to a gate of the transistor;

a second resistor having a first end coupled to the second end of the first resistor and a second end electrically coupled to a second power source configured to supply a second voltage that is lower than the first voltage;

a third resistor coupled between the first power source and the drain of the transistor; and a capacitor having a first end coupled to a source of the transistor and a second end electrically coupled to the second power source, the coupling of the first end of the capacitor to the source of the transistor forming a third voltage supply node having the third voltage when the capacitor is charged.

9. The power supply as claimed in claim 8, wherein the second voltage is a ground voltage.

10. A plasma display device comprising:

a plasma display panel including a plurality of first electrodes, a plurality of second electrodes, a plurality of third electrodes crossing the first and second electrodes and a plurality of discharge cells formed between adjacent ones of the first, second and third electrodes;

a driver, the driver gradually decreasing a voltage of the second electrodes to a first voltage during a reset period, selectively addressing discharge cells from the plurality of discharge cells during an addressing period, applying a second voltage to the first electrodes and the second electrodes during at least a portion of a sustain period, and biasing the first electrodes with a third voltage during a falling period of the reset period and the addressing period; and a power supply, the power supply supplying a plurality of voltages to the driver, the power supply including:

a first power source supplying the second voltage to the first and second electrodes;

a transistor having a drain electrically coupled to the first power source;

a first resistor having a first end coupled to the first power source and a second source electrically coupled to a gate of the transistor;

a second resistor having a first end coupled to the second end of the first resistor and a second end electrically coupled to a second power source supplying a fourth voltage that is lower than the second voltage; and a capacitor having a first end coupled to a source of the transistor and a second end electrically coupled to the second power source, the first end of the capacitor having a voltage based on a charge stored in the capacitor, the coupling of the first end of the capacitor to the source of the transistor forming a third voltage supply node supplying the third voltage to the first electrodes.

11. The plasma display device as claimed in claim 10, wherein at least one of the first resistor and the second resistor is a variable resistor.

12. The plasma display device as claimed in claim 10, further comprising a third resistor coupled between the first power source and the drain of the transistor.

13. The plasma display device as claimed in claim 10, wherein the capacitor is charged with the third voltage when the transistor is turned on.

14. The plasma display device as claimed in claim 10, wherein the fourth voltage is a ground voltage.

15. The plasma display device as claimed in claim 10, wherein the first voltage is lower than the fourth voltage.

16. The plasma display as claimed in claim 10, wherein the third voltage is higher than the fourth voltage.

17. A power supply employable by a plasma display device having first and second electrodes, the power supply configured to generate and supply a plurality of voltages, the power supply comprising:

a first power source configured to generate and supply a first voltage;

a capacitor having a first end and a second end, the second end of the capacitor being connected to a second power source supplying a second voltage;

power distributing means for selectively distributing a portion of the power from the first power source to the capacitor, the first end of the capacitor being connected to the power distributing means and forming a third voltage supply node of the power supply, and when the capacitor is charged, the third voltage supply node having a voltage equal to a third voltage, wherein the first voltage, the second voltage and the third voltage are different voltages, wherein the power supply is configured to alternately supply the first and second electrodes with the first and second voltages during a sustain period, and to bias the second electrodes with the third voltage during an address period.

18. The power supply as claimed in claim 17, wherein the power distributing means includes at least one variable resistor.

19. The power supply as claimed in claim 17, wherein the third voltage is less than the first voltage.

20. The power supply as claimed in claim 17, where in the power distributing means includes a switching device for selectively charging the capacitor.

* * * * *